US006113316A

United States Patent [19]

Ash

[11] Patent Number: 6,113,316

[45] **Date of Patent: *Sep. 5, 2000**

[54] RETAINING WALL SYSTEM

[75] Inventor: David W. Ash, Vancouver, Canada

[73] Assignee: Northern Stresswall Canada Ltd., Vancouver, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,423

[22] Filed: Jun. 17, 1997

[51] Int. Cl.[7] ..... E02D 29/02

[52] U.S. Cl. ..... 405/262; 405/284; 405/286

[58] Field of Search ..... 405/262, 286, 405/285, 273, 284, 272

[56] References Cited

U.S. PATENT DOCUMENTS

| | | | |
|---|---|---|---|
| 554,680 | 2/1896 | Haentges | 405/273 X |
| 1,231,426 | 6/1917 | Ravier | 405/262 |
| 1,701,841 | 2/1929 | Evers et al. | 405/273 |
| 1,871,439 | 8/1932 | Alexander | 405/273 |
| 2,123,016 | 7/1938 | McDaniel | 405/273 |
| 2,193,425 | 3/1940 | Lake | 405/258 |
| 2,197,960 | 4/1940 | Alexander | 405/273 |
| 3,466,874 | 9/1969 | Holl | 405/262 |
| 3,686,873 | 8/1972 | Vidal | 405/262 |
| 4,050,254 | 9/1977 | Meheen et al. . | |
| 4,655,646 | 4/1987 | Babcock et al. . | |
| 4,668,129 | 5/1987 | Babcock et al. . | |
| 4,884,921 | 12/1989 | Smith | 405/258 X |
| 4,929,125 | 5/1990 | Hilfiker | 405/262 |
| 5,456,554 | 10/1995 | Barrett et al. | 405/262 X |

FOREIGN PATENT DOCUMENTS

| | | | |
|---|---|---|---|
| 22812 | 10/1913 | Brazil | 405/262 |
| 0 079 880 | 5/1983 | European Pat. Off. . | |
| 1285976 | 1/1962 | France | 405/284 |
| 80 01780 | 7/1981 | France . | |
| 0078923 | 4/1986 | Japan | 405/262 |
| 0176525 | 7/1988 | Japan | 405/262 |
| 406073744 | 3/1994 | Japan | 405/284 |
| 406294139 | 10/1994 | Japan | 405/284 |
| 0621174 | 1/1981 | Switzerland | 405/284 |
| 2167794 | 6/1986 | United Kingdom | 405/284 |

*Primary Examiner*—Dennis L. Taylor
*Attorney, Agent, or Firm*—Elbie R. de Kock

[57] ABSTRACT

A retaining wall module (1) comprises a wall panel member (2) having a front and a rear provided with a transverse loop (10) at its rear and a footing member (4) mechanically connected to the panel member (2) by means of engagement with the loop (10). In one embodiment the footing member (4) comprises an elongate base and a head (8) at one end of the base for engagement with the loop (10). Also provided is a retaining wall module comprising a pair of opposing wall panel members (2), each having a front and a rear and provided with a transverse loop (10) at its rear and a footing member (46) extending between the rears of the wall panel members (2) and being mechanically connected to each wall panel member (2) by means of the loops (10).

15 Claims, 8 Drawing Sheets

RETAINING WALL SYSTEM

FIELD OF THE INVENTION

The present invention pertains to soil engineering and retaining walls and more specifically to modular precast concrete retention systems.

BACKGROUND OF THE INVENTION

U.S. Pat. No. 4,668,129 (Babcock et al), the entire contents of which is incorporated herein by reference, discloses a modular precast concrete retaining wall system that utilizes rigid counterfort elements that interact with the surrounding backfill or bulk material to redistribute stresses within the retained soil mass. Although the wall configurations disclosed in the above referenced patent are capable of providing high stable retaining walls, none of the walls provide a smooth visually unbroken face. This is because the concrete retaining wall panels are supported at each end by bearing directly upon the vertical columns of each adjacent precast concrete counterfort. These column portions must be of sufficient thickness and strength to withstand the transmitted earth loads from the wall panels retaining the earth mass. The wall configurations of U.S. Pat. No. 4,668,129 typically result in substantial protruding vertical columns that are regularly spaced vertically or horizontally along the length of the retaining wall. Many situations preclude the use of such a retaining wall configuration. For example, if directly next to a roadway the protruding vertical concrete columns may be deemed to be a dangerous obstruction or if columns are incompatible with architectural aspects of the facing.

U.S. Pat. No. 4,655,646 (Babcock et al), attempts to overcome the problem of exposed vertical counterfort columns by providing configurations that hold prestressed wall panels with horizontal continuous precast concrete beams placed at the base and top of the precast concrete counterforts. While the configurations provided by U.S. Pat. No. 4,655,646 eliminate the vertical counterfort columns the disclosed configurations still do not provide a smooth unbroken architectural face. Also, the wall configurations of U.S. Pat. No. 4,655,646 require additional precast beam components which are expensive and difficult to transport and handle. Erection proves most difficult and construction tolerances are greatly reduced.

There are also some prior art retaining wall systems that provide a smooth faced retaining wall structure but none afford the geotechnical engineering benefits of the systems disclosed by U.S. Pat. Nos. 4,668,129 and 4,655,646.

For example, U.S. Pat. No. 4,884,921 discloses a modular "T" unit that can be stacked in multiple configurations to create a smooth faced retaining wall system. However, the stacking of these "T" units creates a brick bonded system from the top to the bottom of the wall system. This direct stacking of the modular units without backfill between adjacent vertical units precludes soil arching and provides none of the desired geotechnical benefits disclosed by U.S. Pat. No. 4,668,129.

It would, therefore, be desirable to provide a modular precast retaining wall system that simply and economically provides a smooth faced retaining wall but maintains the geotechnical design advantages of the wall system of U.S. Pat. No. 4,668,129.

SUMMARY OF THE INVENTION

According to the invention there is provided a retaining wall module comprising a wall panel member having a front and a rear and provided with a transverse loop at its rear and a footing member mechanically connected to said panel member by means of engagement with said loop.

Also according to the invention there is provided a retaining wall module comprising a pair of opposing wall panel members, each having a front and a rear and provided with a transverse loop at its rear and a footing member extending between the rears of said wall panel members and being mechanically connected to each wall panel member by means of said loops.

Further objects and advantages of the invention will become apparent from the description of preferred embodiments of the invention below.

DETAILED DESCRIPTION OF PREFERRED EMBODIMENTS

Figure 1:
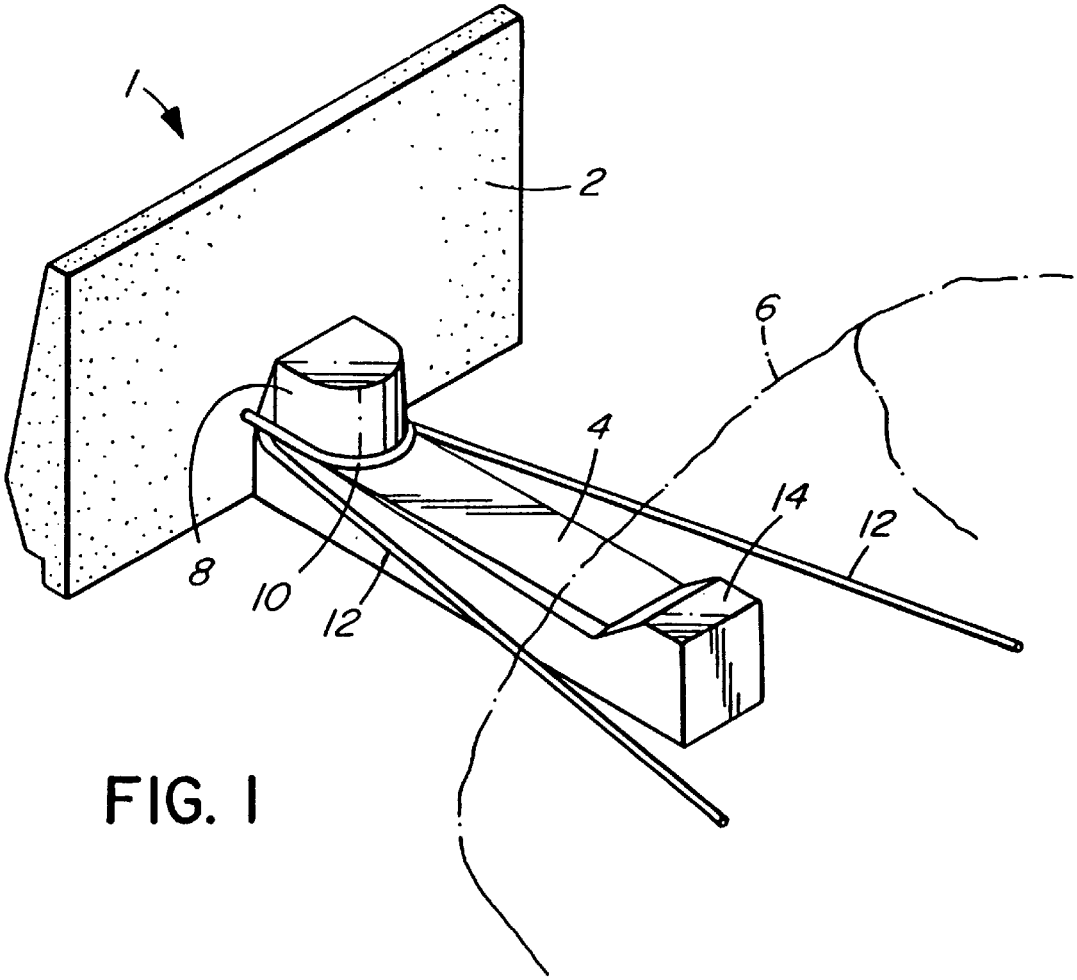
FIG. 1 is an isometric view, from within a soil mass, of an assembled precast concrete module of the present invention, comprising a panel and a footing member.

FIG. 1 shows an assembled retaining wall module 1 of the present invention. The assembled components depicted in FIG. 1 comprise a precast concrete wall panel member 2 and a precast concrete footing member 4. Panel 2 is mechanically attached to the footing member 4 by a connecting loop 10 that is an integral component of panel 2. Connecting loop 10 fits into a matching connecting loop groove 20 (FIG. 2) that is a manufactured component of footing member 4. Connecting loop 10 may be made of any structurally suitable material, such as a steel rod or cable, and be incorporated into panel 2 by any conventional method.

Figure 5:
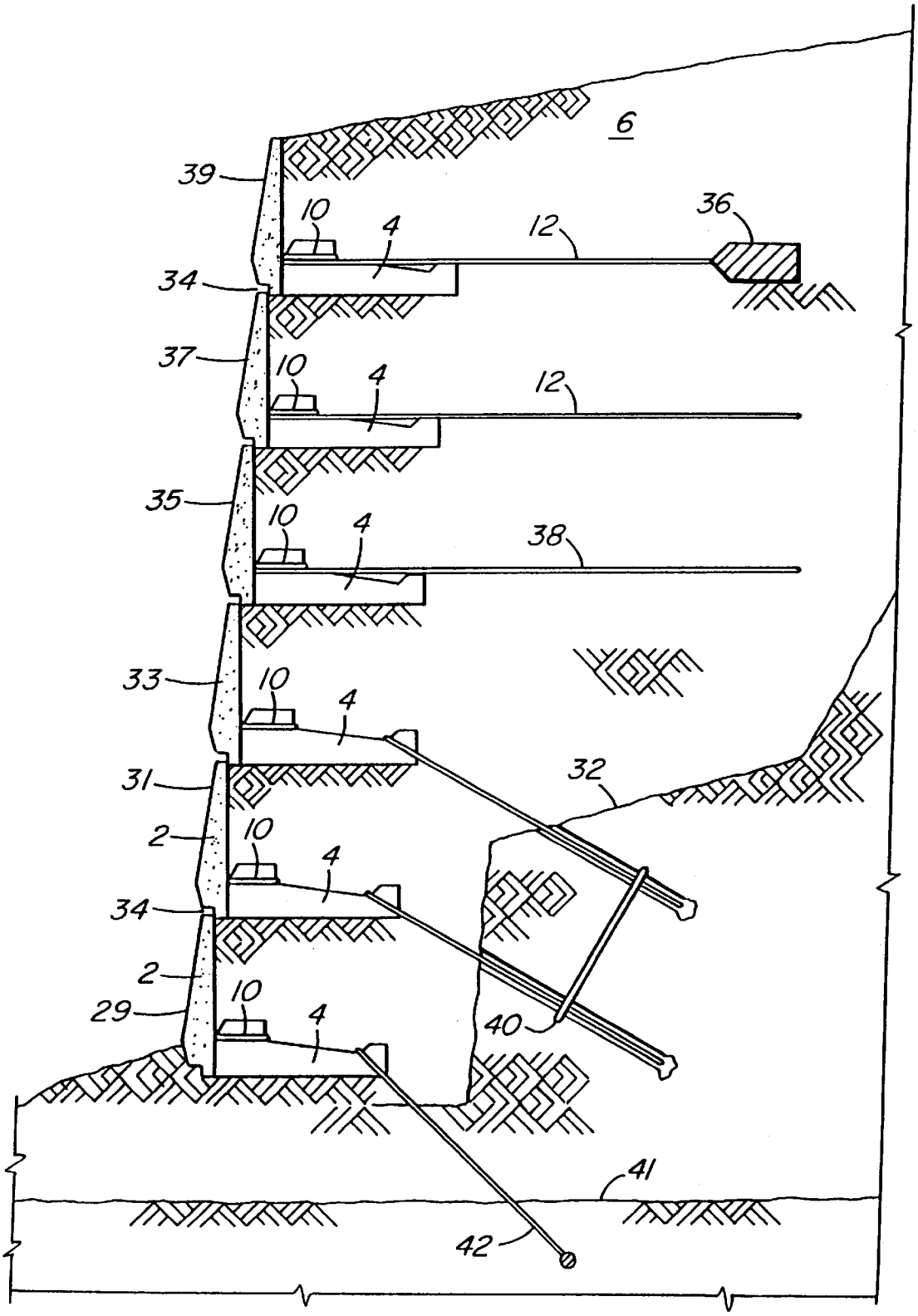
FIG. 5 is a cross-sectional view of a six tier wall system illustrating the use of tie-backs, anchors, geogrid elements, soil nails and rock anchors in conjunction with the present invention.

Also shown in FIG. 1 are compacted backfill material 6 and extension clip 12. Extension clip 12 is a continuous tie-back element which is preferably in the form of a rigid steel rod. It is attached to footing member 4 by looping it into a connecting groove 22 (FIG. 2) that is part of footing head 8. Once attached to the footing member 4, extension clip 12 may be used to strengthen and stabilize backfill material 6 or may be connected to a deadman anchor 36, as shown in FIG. 5. Footing member 4 is also manufactured with a raised formation 14 to securely lock the retaining wall module 1 into the material backfill 6.

Multiple retaining wall modules 1 can be used to construct numerous retaining wall configurations to meet design requirements. More specific design methods and the geotechnical engineering advantages are described in U.S. Pat. No. 4,668,129 the contents of which has been incorporated herein.

Figure 2:
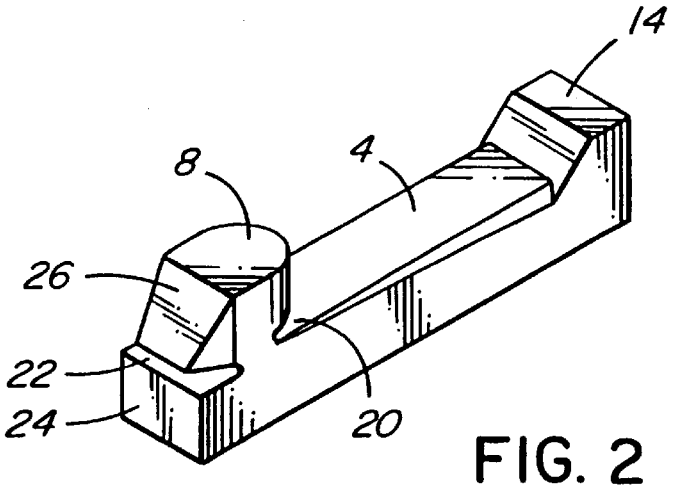
FIG. 2 is an isometric view showing the footing member of the module of FIG. 1.

FIG. 2 more fully illustrates the footing member 4 of the retaining wall module 1 of FIG. 1. Footing member 4 is of a general rectangular shape with the head portion 8 having an assembly facet 26 and connecting grooves 20 and 22. Footing member 4 is typically manufactured having a flat bottom to facilitate alignment on a graded surface and backfill interaction, respectively. Footing member 4 includes a panel bearing area 24. Head 8 must be of sufficient size and strength to withstand the shear forces imparted by connecting loop 10 (FIG. 1) and the shear forces generated by extension clip 12 when used. Panel bearing area 24 is used to effect the final alignment of panel 2 with footing member 4.

Figure 3:
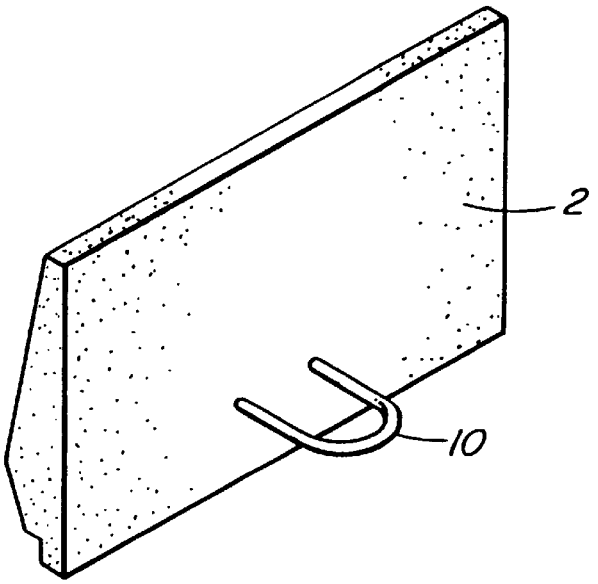
FIG. 3 is an isometric view showing the panel of the module of FIG. 1.

FIG. 3 more fully discloses panel member 2 of the retaining wall module 1 depicted in FIG. 1. Panel 2 is of general rectangular shape having connecting loop 10 laterally centered on the rear of the panel 2. Panel 2 must be of sufficient thickness and strength to transmit the retained earth loads from panel 2 through the moment connection between connecting loop 10 and panel bearing area 24 to the coupled footing member 4 (FIG. 1). The edge cross section of panel 2 may be varied as dictated by design or architectural requirements.

Figure 4:
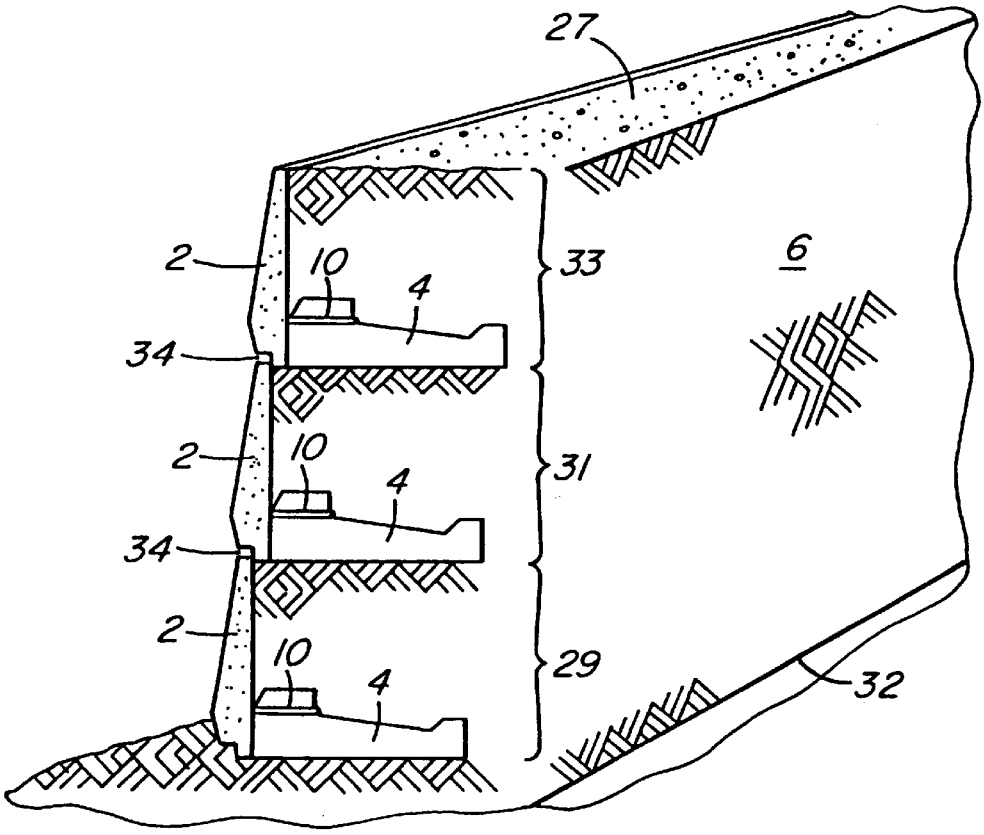
FIG. 4 is a cross-sectional view of an assembled three tier wall system of one embodiment of the present invention.

FIG. 4 shows a cross section of a typical three tier retaining wall using the retaining wall modules 1 of the present invention. Tier one components 29 are erected on a base excavation 32 and backfill 6 is placed to the level of the base of the next higher tier 31. Tier two components 31 are then erected and backfill placed up to the base level of the top tier components 33. Finally, backfill 6 is placed for the tier three retaining wall components 33 and compacted to the final grade line 27. Multiple retaining wall modules as described in FIG. 1, comprising panels 2 connected to footing members 4 by connecting loops 10 are used to construct the three tier wall. A clearance 34 is provided between adjacent tiers to allow for vertical movement between the vertically adjacent tiers and is maintained during the construction sequence so that the footing member 4 can react with the backfill 6 to produce the stable retention structure.

FIG. 5 illustrates the use of a vertical tiered configuration of the retaining wall modules of FIG. 1 in conjunction with additional stabilization devices that may be required by specific retaining wall designs. Again, the retaining wall modules comprise panels 2 connected to footing member 4 by means of connecting loops 10 (FIG. 1). In this case, tier 29 is placed at the base of excavation 32 and is anchored to bedrock 41 by rock anchor 42. After the backfill is placed and compacted to a grade at the top of tier 29 the second tier 31 modules are placed and erected. The tier 31 footing members are in this case anchored by soil nails 40 before backfill 6 is placed and compacted for tier 31. Similarly, third tier 33 footing members are anchored by soil nails 40 after being erected. The footing members 4 used as components for tier 29 through tier 33 are designed and manufactured to accept the rock anchors or soil nails and may be field modified as required. Once the backfill 6 is placed to a grade at the top of tier 33, the fourth tier 35 components are erected. The tier 35 retaining wall modules are used in conjunction with a geogrid 38 stabilizing element attached by placing the footing member 4 over the geogrid 38.

The fifth tier 37, of the retaining wall system, illustrated in FIG. 5, incorporates extension clips 12 attached as depicted in FIG. 1 to the retaining wall modules to increase stability in the lateral direction. In this case, the lateral resistance provided by the extension clip 12 embedded in backfill 6 is sufficient to provide a required additional lateral resistance.

Finally, for tier six of the wall system, the extension clip 12 attached to the tier six retaining wall modules 39 is also connected to a deadman anchor 36 to generate an additional required lateral resistance after backfill 6 is placed to plan and grade.

Figure 6:
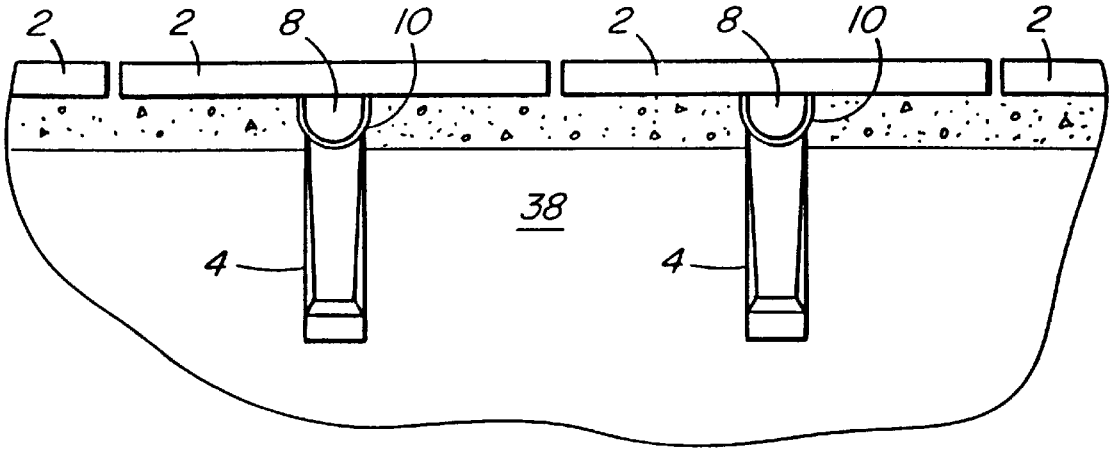
FIG. 6 is a plan view of one row of the modules of FIG. 1.

A plan view more fully illustrating the use and attachment of an extension clip 12 in conjunction with the retaining wall modules 1 of the present invention is presented in FIG. 6 and will be described in more detail below.

Deadman anchors 36 would typically be necessary on the top tiers of walls constructed in high seismic zones or in cases where a wall supports a significant active surcharge load such as a railroad. The wall system depicted in FIG. 5 is a hybrid system specifically chosen to illustrate the use of known techniques and components of the earth retention art with the precast concrete retaining wall module 1 of the present invention.

The use of a geogrid 38 in conjunction with the precast concrete modules 1 of this invention. The required geogrid material 38 is placed on a graded surface and footing members 4 placed on geogrid 38. Once the footing member 4 has been placed on geogrid 38, the panels 2 are coupled to the footing members 4 by connecting loops 10. The coupling sequence between panel and dart 4 is fully illustrated in FIGS. 9 through 12 and will be described more fully below.

Figure 7:
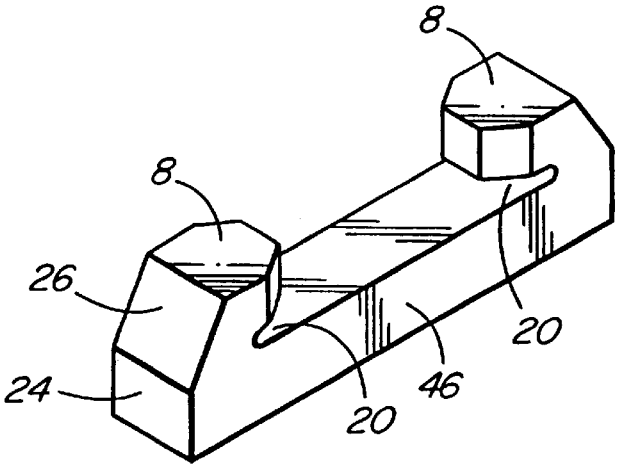
FIG. 7 is an isometric view showing a two-headed or fence footing member for use in the implementation of the present invention as a free standing fence or sound wall.

FIG. 7 illustrates a specific variation of the footing member 4 of the present invention. In this embodiment, the footing member is precast having two heads 8, one on each opposing end, to create a fence footing member 46. Both heads of the fence footing member 46 have associated connecting grooves 20 and panel bearing areas 24. The utility of the fence footing member 46 is that it allows the creation of free standing precast concrete wall structures which may be utilized as fences, median dividers, and sound walls, for material segration etc. The design width of fence footing member 46 and/or the batter angle of panel bearing surface 24 can be varied as desired and provide the degree of versatility necessary to create structures of varied geometries. For example, a structure having a trapezoidal cross section may be built by stacking fence footing members 46 of decreasing width.

Figure 8:
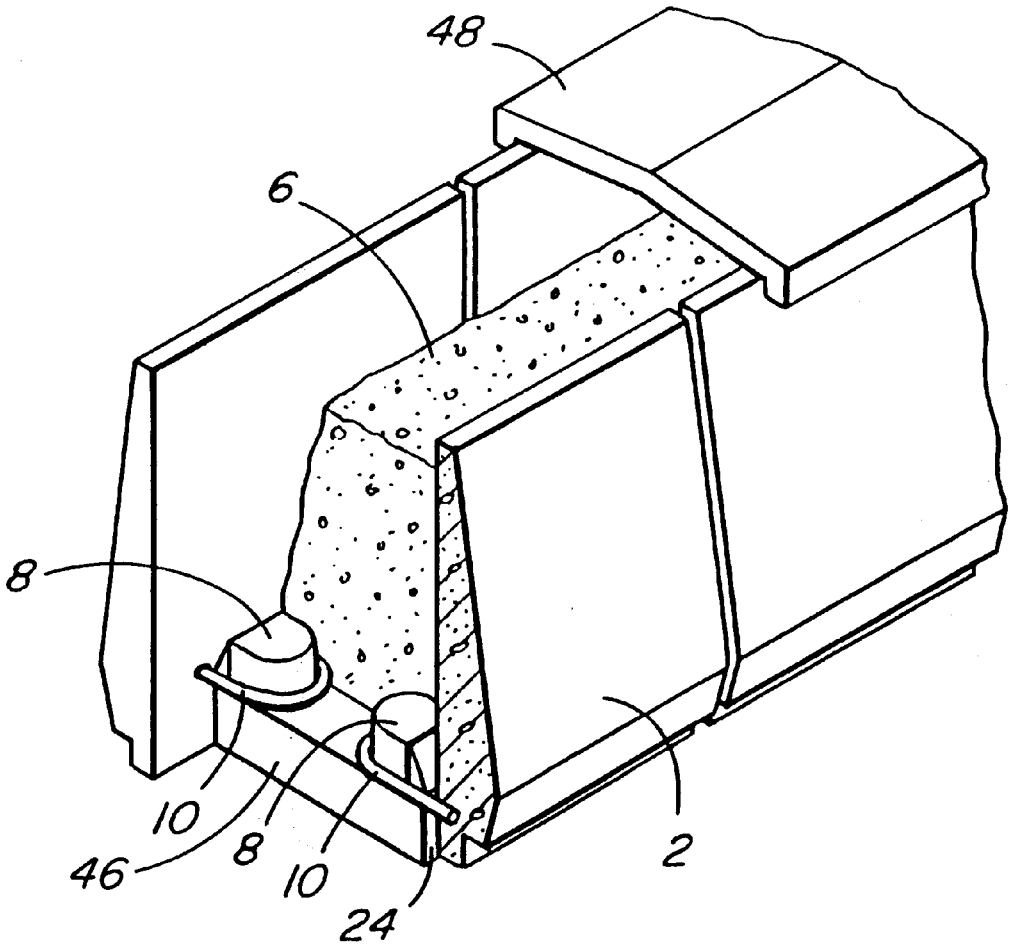
FIG. 8 is an isometric view showing the implementation of the present invention as a free standing fence or sound wall.

FIG. 8 shows an isometric cut-away drawing of a single tier free standing wall construction using fence footing member 46. Panels 2 are coupled to both ends of the fence footing member 46 by connecting loops 10 that are hooked over each head 8. Panels bear on the panel bearing area 24. Backfill 6 is placed, to a design elevation, between panels 2 for added mass and increased stability. A fence cap 48 covers and joins the two opposing panels 2. In the fence or free standing wall configuration horizontal earth loads are substantially decreased by the reduced volume of backfill 6. This allows significantly taller panels to be supported in the fence configurations. Not illustrated in FIG. 8 is multi-tier free standing wall using the fence footing member 46. In a multi-tier fence configuration the tiers may be stacked vertically as backfill 6 is placed and then the fence cap 48 covers the opposing panels of the top most tier.

Figure 9:
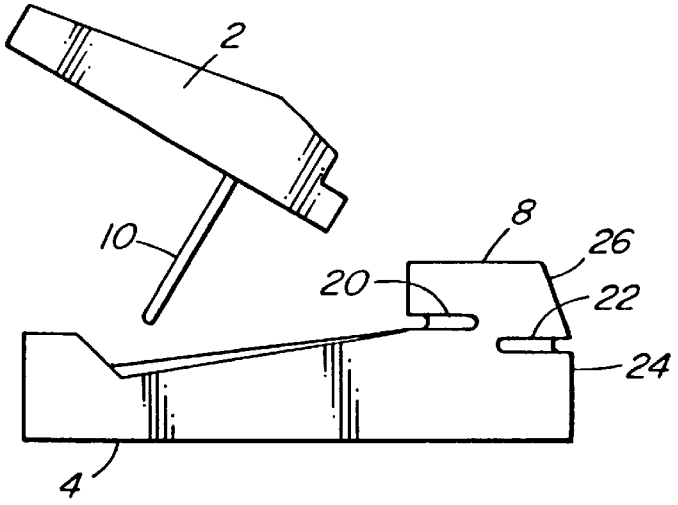
FIGS. 9 through 12 illustrate the assembly sequence for the wall panel and footing member of FIG. 1.
Figure 10:
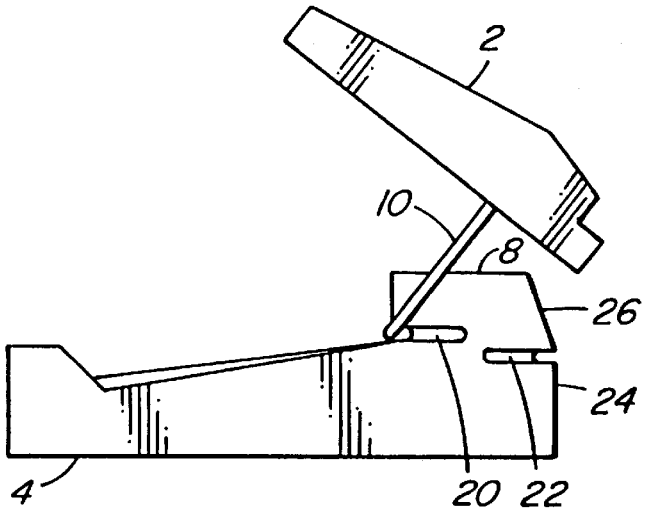
Figure 11:
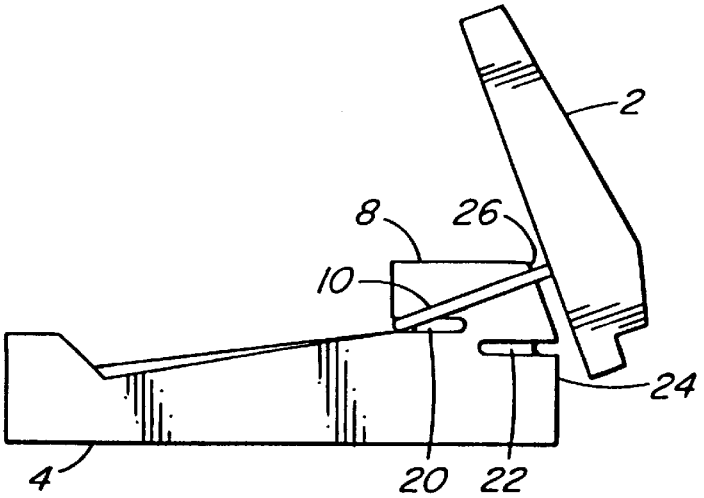
Figure 12:
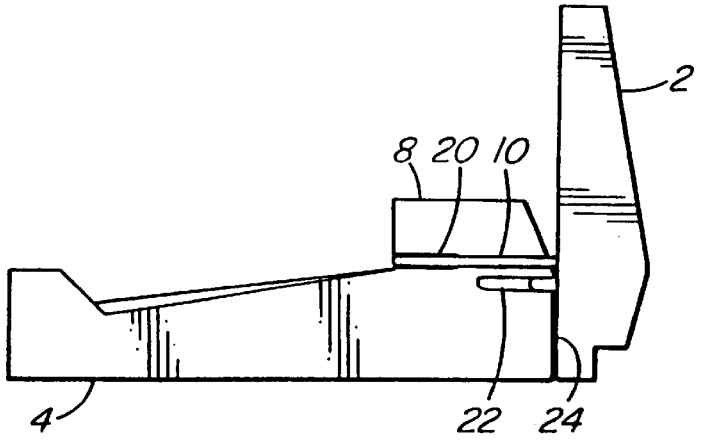

FIGS. 9 and 12 are a series of sequential illustrations detailing the assembly method for the retaining wall module 1. The panel 2 is mechanically coupled, at its lateral center point, to footing member 4 by connecting loop 10. A necessary requirement to create a secure rigid coupling of panel 2 with footing member 4 is that connecting loop 10 be firmly fixed into connecting loop groove 20. FIG. 9 depicts the two components prior to assembly. The footing member 4 is positioned to line and grade and any required extensions clips are connected to footing member 4 at connecting groove 22. The panel 2 is then supported above and at an angle to the footing member head 8 with a hand truck, a crane, or manually, depending upon the size and weight of panel 2. The panel positioning depicted in FIG. 9 facilitates hooking connecting loop 10 in connecting groove 20 on the head 8 of footing member 4 as illustrated in FIG. 10. FIGS. 10 and 11 also illustrate the utility of assembly facet 26 which allows panel 2 to rotate to a vertical position without impinging upon footing member head 8 while keeping connecting loop 10 securely seated in connecting groove 20.

FIG. 12 illustrates a completely assembled retaining wall module 1 of the present invention. Loads from panel 2 are transferred to footing member 4 at the panel bearing area 24. When required by design, an extension clip may be attached to footing member 4 at connecting groove 22 during assembly of the retaining wall module 1.

Figure 13:
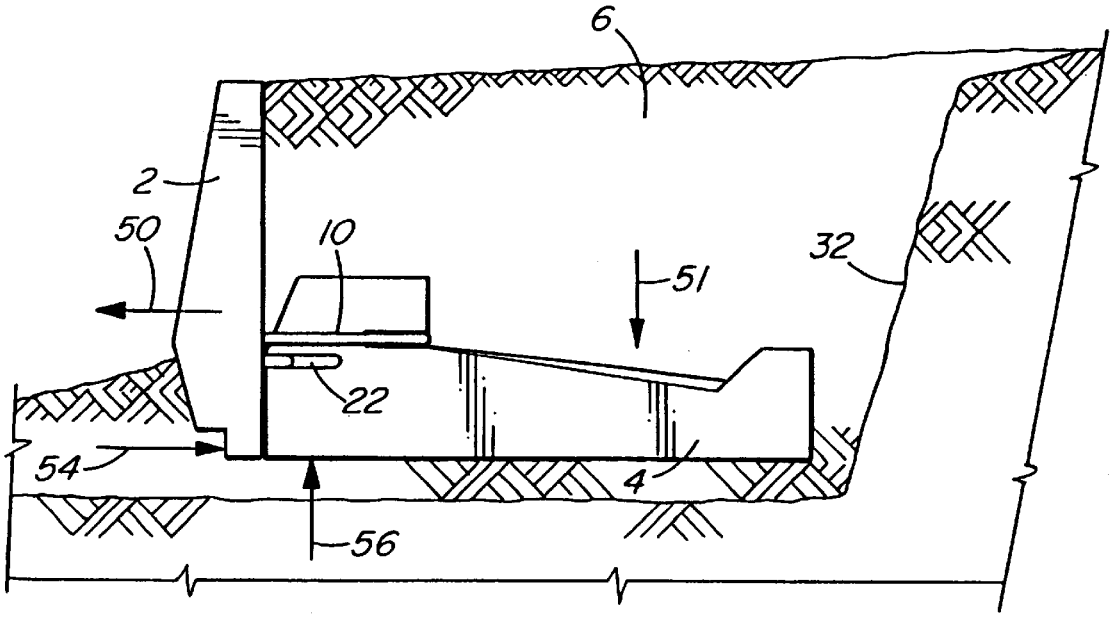
FIG. 13 is a schematic illustration of resultant load vectors on a typical modular unit of the present invention.

FIG. 13 is a schematic cross-section of a single tier retaining wall, using the retaining wall module 1 of this invention, that illustrates the resultant force vectors generated by earth loads upon the assembled and backfilled module. Backfill 6 is placed in excavation 32 covering footing member 4 and is retained by panel 2. Backfill 6 having specific design characteristics exerts lateral force 50 on panel 2 which is transferred to footing member 4 through connecting loop 10 and vertical force 51 on footing member 4. The lateral force 50 is opposed by friction force 54 that is generated as a result of material reactions to loading from backfill 6. Geotechnical design insures that satisfactory design factors of safety are maintained for each specific retaining wall installation. A detailed description of geotechnical design procedures is disclosed by U.S. Pat. No. 4,668,129 which has been incorporated herein.

Figure 14:
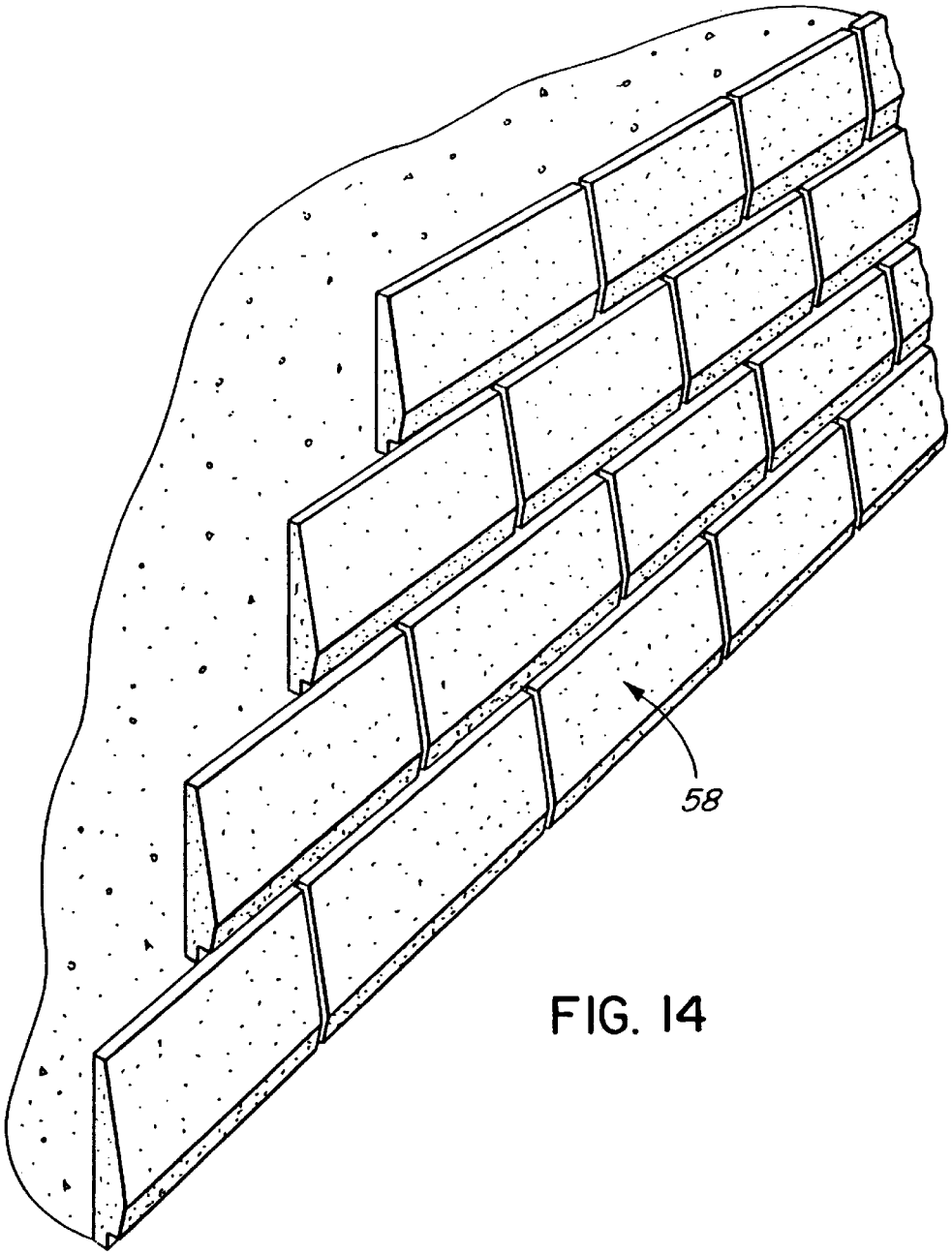
FIG. 14 is a perspective view of an implementation of a multi-tier retaining wall using the present invention.

FIG. 14 is a perspective view of a completed retaining wall of retaining wall modules 1 of the present invention and illustrates the smooth unbroken architectural wall face 58 that is achieved with the invention.

The present invention, therefore, provides a novel and unique method and apparatus for building precast concrete retaining walls having architecturally uniform wall faces while using a geotechnically preferred design procedure. The necessary precast concrete components (footing member and panel) assemble to make a standardized retaining wall module that can be used to create many and varied retention structures. A special fence footing member component allows the invention to be used to build free standing median dividers, fences, and sound walls. Unlike prior retaining walls of this type the present invention allows the coupling of the panel to the footing member (counterfort) to be made at the lateral mid-point of the panel. The structural forces are therefore concentrated toward the center of the precast panel where it is most desirable structurally. Previous walls of this type effected the load transfer between panel and counterfort at the panel edges where it is difficult and expensive to provide the necessary structural reinforcement.

The foregoing description of the invention has been presented for purposes of illustration and description. It is not intended to be exhaustive or to limit the invention to the precise form disclosed, and other modifications may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention, except insofar as limited by the prior art.

What is claimed is:

1. A retaining wall module, comprising:

a wall panel member having a base, a front and a rear and provided with a connecting loop at its rear; and a footing member at the rear of the wall panel member comprising a base provided with a head rigid with the base, the head being in engagement with said connecting loop, the footing member further having a planar panel bearing area adjacent said head bearing against the rear of the wall panel at the base of the said wall panel.

2. The retaining wall module according to claim 1, wherein the connecting loop is located substantially centrally of the wall panel member.

3. The retaining wall module according to claim 1, wherein the connecting loop is of a rigid material.

4. The retaining wall module according to claim 1, wherein the panel member is of precast concrete and the connecting loop is formed integrally with the panel member.

5. The retaining wall module according to claim 1, wherein said footing member comprises an elongate base with the head at one end of the base.

6. The retaining wall module according to claim 1, wherein said footing member is provided with a groove on said head for accommodating said loop.

7. The retaining wall module according to claim 1, wherein said footing member is provided with a secondary groove thereon for engagement with a tie-back member extending rearwardly of said wall panel member.

8. A modular retaining wall system comprising a plurality of the modules according to claim 1 arranged in a row along the ground with the wall panel members in abutting relationship with one another.

9. The modular retaining wall system according to claim 8, comprising a plurality of said rows arranged in tiers.

10. The retaining wall module according to claim 1, wherein the footing member is a precast concrete member.

11. A retaining wall module, comprising a pair of opposing wall panel members, each having a base, a front and a rear and each provided with a connecting loop at its rear; and a footing member extending between the rears of said wall panel members, the footing member having opposite ends respectively located at the rear of the panel members, each end provided with a head rigid with the footing member, the head being in engagement with the respective connecting loop and each of said opposite ends being provided with a planar panel bearing area adjacent each respective head bearing against the rear of the respective wall panel at base of the respective wall panel.

12. A modular wall system comprising a plurality of the modules according to claim 11 arranged in a row along the ground with the wall panel members in abutting relationship with one another.

13. The modular wall system according to claim 12, comprising a plurality of said rows arranged in tiers.

14. The modular wall system according to claim 12, including a filler material between the opposing wall panel members.

15. The modular wall system according to claim 13, further comprising a cap component covering and connecting the opposing wall panel members in the upper tier.

* * * * *